US005928042A

United States Patent [19]

Quiggins

[11] Patent Number: 5,928,042

[45] Date of Patent: Jul. 27, 1999

[54] PROPELLER GUARD

[75] Inventor: James H. Quiggins, Houston, Tex.

[73] Assignee: Glenn F. Mattina, Biloxi, Miss.

[21] Appl. No.: 09/048,108

[22] Filed: Mar. 26, 1998

Related U.S. Application Data

[60] Provisional application No. 60/041,773, Mar. 31, 1997.

[51] Int. Cl.[6] ..... B63H 5/16

[52] U.S. Cl. ..... 440/72; 416/247 A

[58] Field of Search ..... 440/49, 68, 69, 440/70, 71, 72, 73; 416/247 A, 247 R

[56] References Cited

U.S. PATENT DOCUMENTS

| | | | |
|---|---|---|---|
| D. 322,256 | 12/1991 | Reeves | D15/4 |
| D. 325,916 | 5/1992 | Lanier | D12/70 |
| 1,620,129 | 3/1927 | Peterson . | |
| 2,983,246 | 5/1961 | Manley | 440/72 |
| 4,013,033 | 3/1977 | Porter et al. | 440/72 |
| 4,070,984 | 1/1978 | Kappas | 115/42 |
| 4,078,516 | 3/1978 | Balius | 440/72 |
| 4,680,017 | 7/1987 | Eller | 440/71 |
| 4,957,459 | 9/1990 | Snyder | 440/72 |
| 5,009,620 | 4/1991 | Feranda, Sr. | 440/72 |
| 5,205,766 | 4/1993 | Arsenault | 440/72 |
| 5,431,544 | 7/1995 | Hsu et al. | 416/247 R |
| 5,470,262 | 11/1995 | Bustillo, Sr. | 440/72 |

*Primary Examiner*—Stephen Avila

*Attorney, Agent, or Firm*—Jacobson, Price, Holman & Stern, PLLC

[57] ABSTRACT

A propeller guard for use in association with a boat propulsion propeller driven by an outboard motor or an inboard/outboard rear motor drive unit. The propeller guard may be constructed of injection molded plastic, fiber reinforced resin, metal such as aluminum or other materials having strength characteristics to provide necessary protection and constructed to minimize hydrodynamic resistance. The propeller guard will protect swimmers, aquatic mammals and other sea life from coming into contact with the propeller thereby preventing injury and at the same time protect the propeller from damage by engagement with floating or submerged debris.

18 Claims, 7 Drawing Sheets

PROPELLER GUARD

CROSS REFERENCE TO RELATED APPLICATION

This application is a continuation-in-part of provisional application for ITC PROPELLER GUARD filed Mar. 31, 1997, Ser. No. 60/041,773.

BACKGROUND OF THE INVENTION

1. Field of the Invention

The present invention generally relates to a propeller guard for use in association with a boat propulsion propeller driven by an outboard motor or an inboard/outboard drive unit. The propeller guard is constructed of injection molded plastic, metal such as aluminum or other metals, fiber reinforced resin plastic or other materials having strength characteristics to provide necessary protection and constructed to minimize hydrodynamic resistance. The propeller guard will protect swimmers and aquatic mammals from coming into contact with the propeller thereby preventing injury and at the same time protect the propeller from damage by engagement with floating or submerged debris.

2. Description of the Prior Art

Propeller guards or shrouds have been developed for use with outboard motors and usually are constructed from metal without concern regarding motor performance and resistance to movement of the guard or shroud through the water. Such devices presently available have proven to be less than totally successful from a use standpoint and from a marketing standpoint in view of the manufacturing processes and added weight of metal guards or shrouds.

The following U.S. patents illustrate developments in this field of endeavor.

| | | |
|---|---|---|
| 322,256 | 4,013,033 | 4,957,459 |
| 325,916 | 4,070,984 | 5,009,620 |
| 1,620,129 | 4,078,516 | 5,205,766 |
| 2,983,246 | 4,680,017 | 5,470,262 |

The above prior patents disclose various guard structures for outboard motor propellers including a gridlike structure surrounding the propeller and enabling water flow past and through the propeller guard. However, the above patents do not disclose a structure equivalent to the structure of the propeller guard of the present invention including the particular arrangement of axially spaced, circumferentially extending, concentric rings or bands retained in fixed relation by a unique support spoke structure interconnecting the rings and bands and a unique attachment arrangement for supporting the guard from the cavitation plate and skeg of the propeller drive unit.

SUMMARY OF THE INVENTION

In view of the increased use of boats of various sizes and types in and around areas sometimes occupied by swimmers or other persons, the injuries to humans and aquatic mammals has increased substantially from contact of the propeller with the soft tissue flesh of humans and aquatic mammals. Various efforts have been made to develop a propeller guard that seeks to protect both humans and aquatic mammals without severe degradation to the performance of the boat.

The propeller guard of the present invention provides a more effective propeller guard constructed of injection molded plastic, metal such as aluminum, other metals, fiber reinforced resin or other materials incorporating a central relatively wide, generally circular ring or band in alignment with and enclosing the periphery of the propeller throughout its axial extent combined with forwardly spaced and rearwardly spaced concentric rings that are axially spaced from each other and supported by radially extending inclined supports or spokes. The wide ring has opposed mounting brackets at an upper portion thereof attached to opposed edge portions of a cavitation plate on the propeller drive unit housing. The lower portion of the wide ring of the propeller guard is supported from and attached to the skeg which depends from the propeller shaft housing. The wide ring is separated into two sections by a central seam which enables the propeller guard to be formed of two pieces which are secured together by fasteners after the two pieces of the guard has been assembled in enclosing relation to he propeller. The wide ring and spaced forward and rear rings form an effective enclosure for the periphery of the rotating propeller as well as forming protection for the area of the propeller drive unit forwardly and rearwardly of the propeller.

An object of the present invention is to provide a propeller guard which will protect human beings and aquatic mammals in a body of water from injury due to contact with a rotating boat propeller and to protect the propeller from damage due to contact with floating or underwater debris or obstacles.

Another object of the invention is to provide a propeller guard constructed from plastic, metal or other materials which adds little weight to the propeller drive unit while effectively protecting the propeller and providing minimum degradation of the performance of the boat and small resistance to movement of the guard through the water or movement of water in relation to the guard.

A further object of the invention is to provide a propeller guard consisting essentially of a centrally located relatively wide ring or band oriented in enclosing relation to the periphery of the propeller in generally concentric relation to the rotational axis of the propeller and propeller shaft combined with forwardly disposed and rearwardly disposed concentric rings spaced from each other concentrically and spaced from each other axially and supported by radially extending and inclined or curved support spokes to provide a structure having adequate strength to protect the propeller from contact with humans, aquatic sea life or stationary or floating obstacles.

Still another object of the invention is to provide a propeller guard in accordance with the preceding objects including a unique mounting structure for the guard including a slotted bracket at two upper ends of a wide central ring for attachment to opposed edges of a cavitation plate and a slotted bracket at the lower portion of the propeller guard for attachment to a skeg on the propeller drive unit thus effectively securing the propeller guard to the cavitation plate and skeg.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
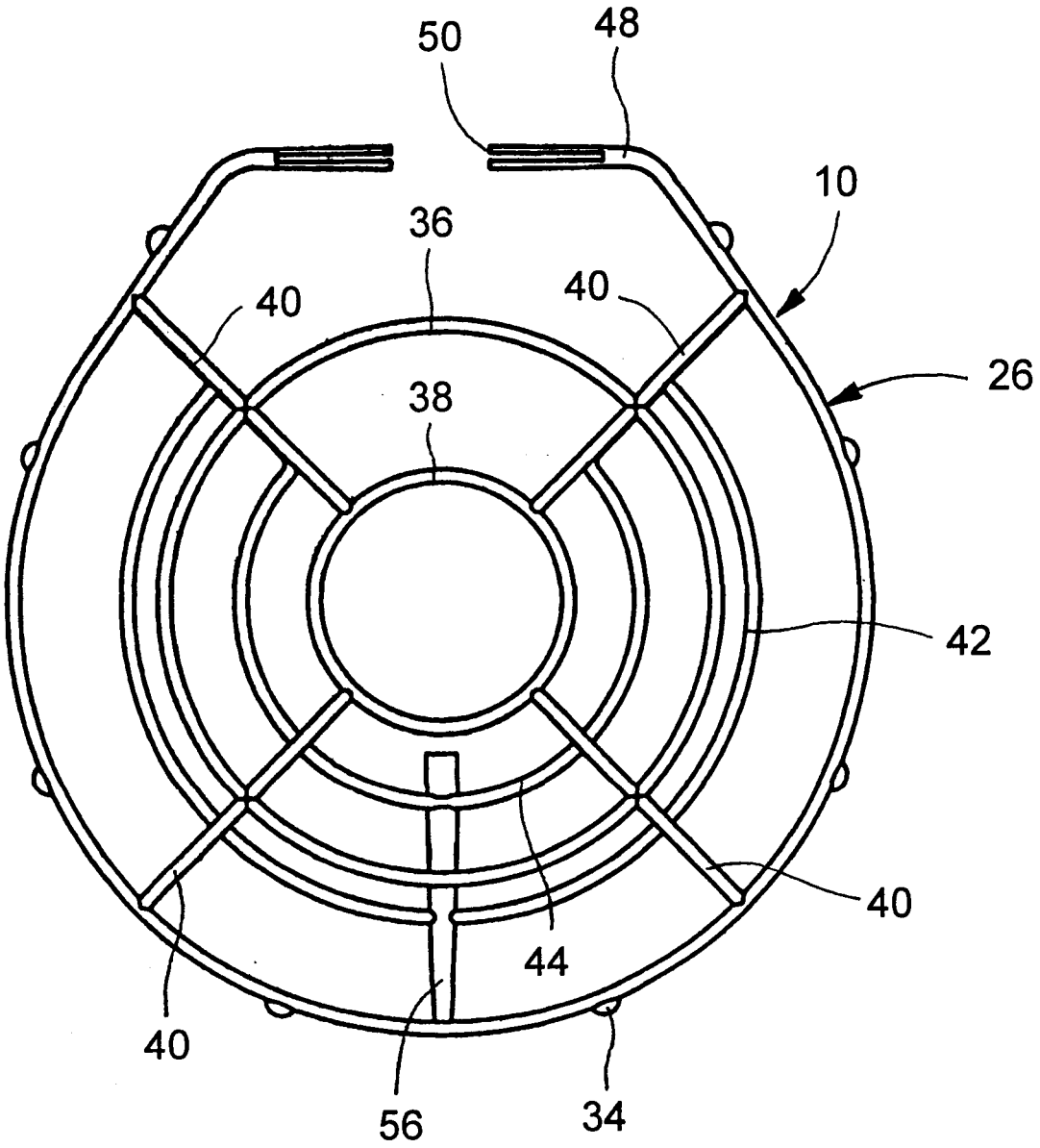
FIG. 1 is a rear elevational view of the preferred embodiment for the propeller guard of the present invention.

Although only one preferred embodiment of the invention is explained in detail, it is to be understood that the invention is not limited in its scope to the details of construction and the arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 6:
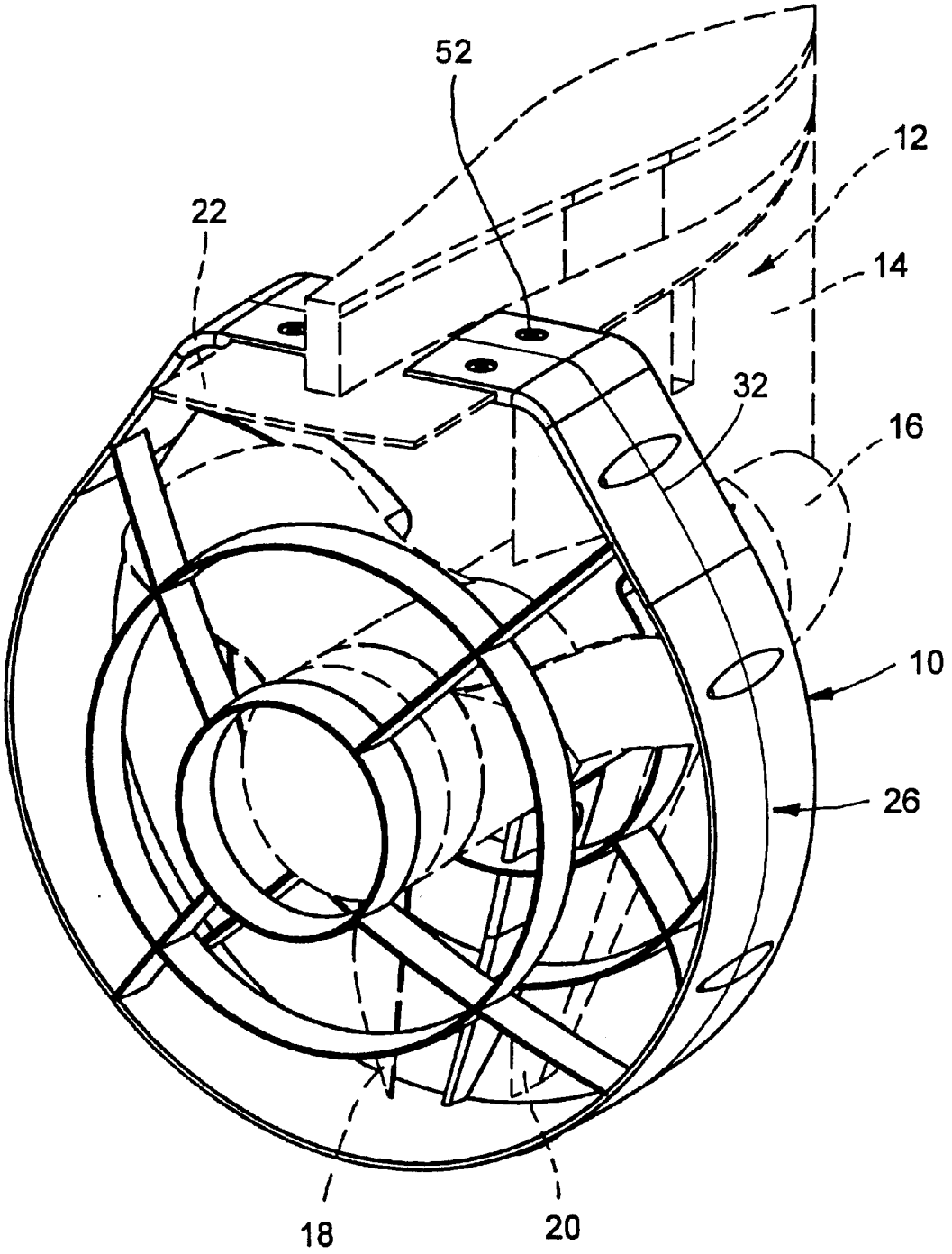
FIG. 6 is a rear prospective view of the propeller guard of FIG. 1 illustrating its association with a propeller drive unit illustrated in broken lines.
Figure 7:
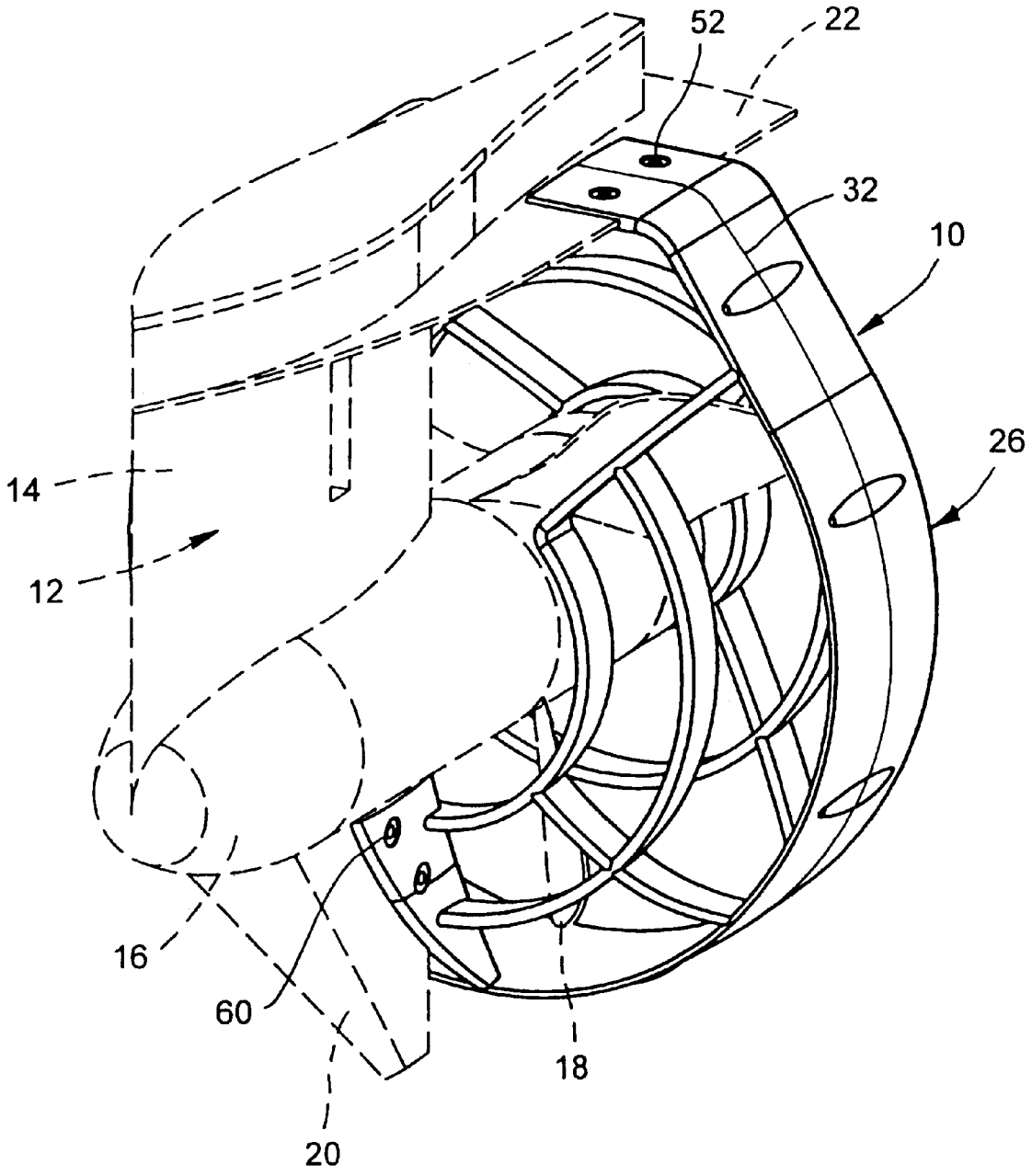
FIG. 7 is a front prospective view of the propeller guard of FIG. 1 illustrating its association with the propeller drive unit shown in broken lines.

Referring now to the drawings, the propeller guard is generally designated by reference numeral 10 and, as illustrated in FIGS. 6 and 7, it is associated with a propeller drive unit generally designated by reference numeral 12 which includes an upper housing 14, a propeller shaft housing 16, a propeller 18 which rotates about a generally horizontally disposed axis defined by a propeller drive shaft (not shown). The propeller shaft housing 16 includes a depending protective member in the form of a skeg 20 and the housing 14 includes a generally horizontally disposed cavitation plate 22 extending rearwardly in overlying relation to the propeller 18. All of the propeller drive unit 12 is conventional and well known in the art. The propeller guard 10 of the present invention is supported from the propeller drive unit 12 in a manner described hereinafter and protects the propeller from damage by engagement with underwater obstacles, floating debris or the like and prevents injury caused by contact between humans or sea mammals and the rotating propeller blade 18.

The propeller guard 10 is constructed of injection molded plastic, metal, fiber reinforced resin plastic or other materials having sufficient strength for effectively protecting the propeller 18. The propeller guard 10 includes a centrally disposed, relatively wide ring 26 that is divided into two sections 28 and 30 along a central seam 32. The sections 28 and 30 can be fastened together for assembly of the propeller guard 10 in relation to the propeller 18. The sections 28 and 30 of the ring 26 include ridges 34 which receive fasteners 35 such as small bolts and nuts to secure the sections 28 and 30 in rigid contacting engagement and the ridges or projections 34 reinforces the band and provides rigidity between the front and rear edges of the band.

Figure 2:
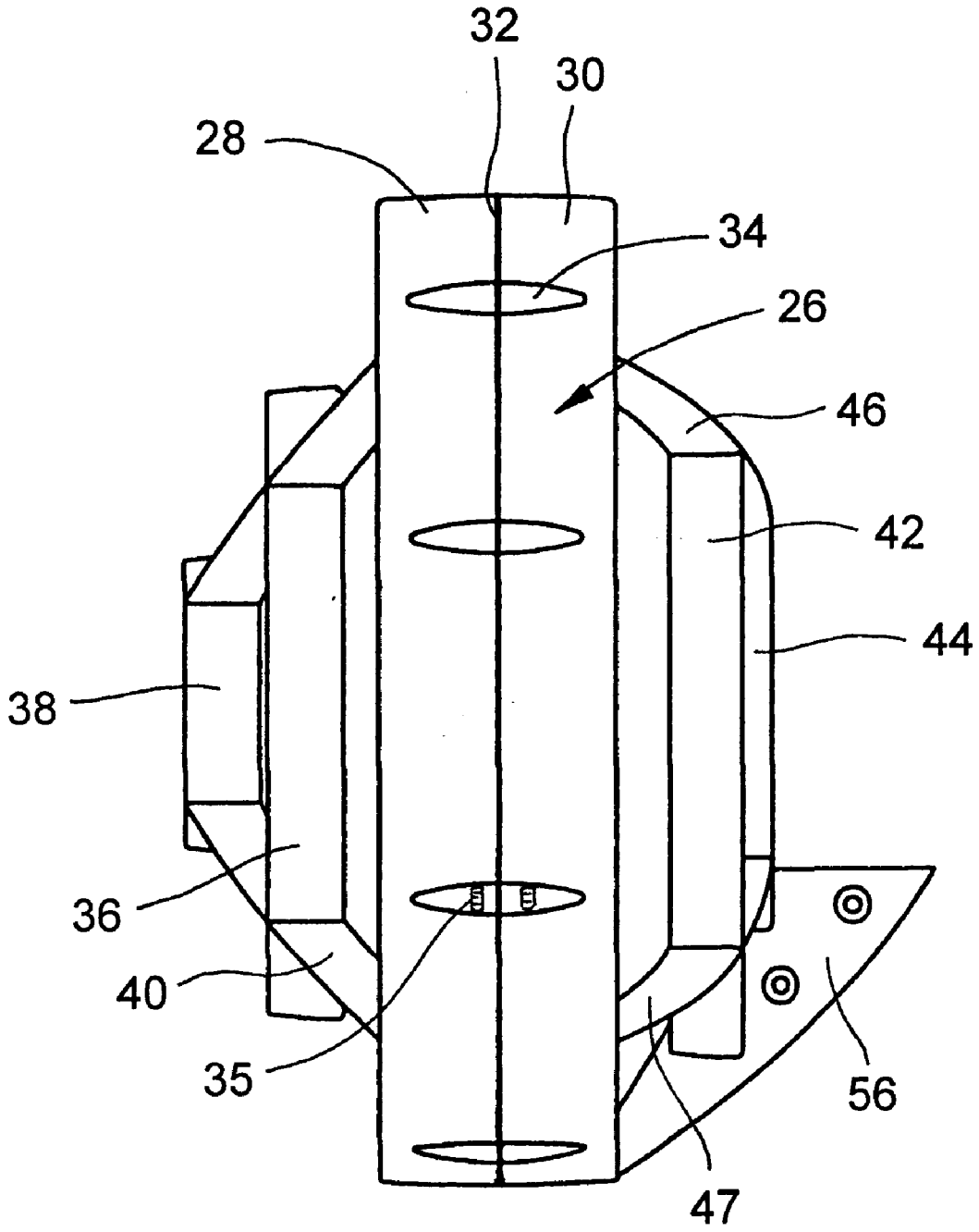
FIG. 2 is a side elevational view of the propeller guard of FIG. 1.
Figure 3:
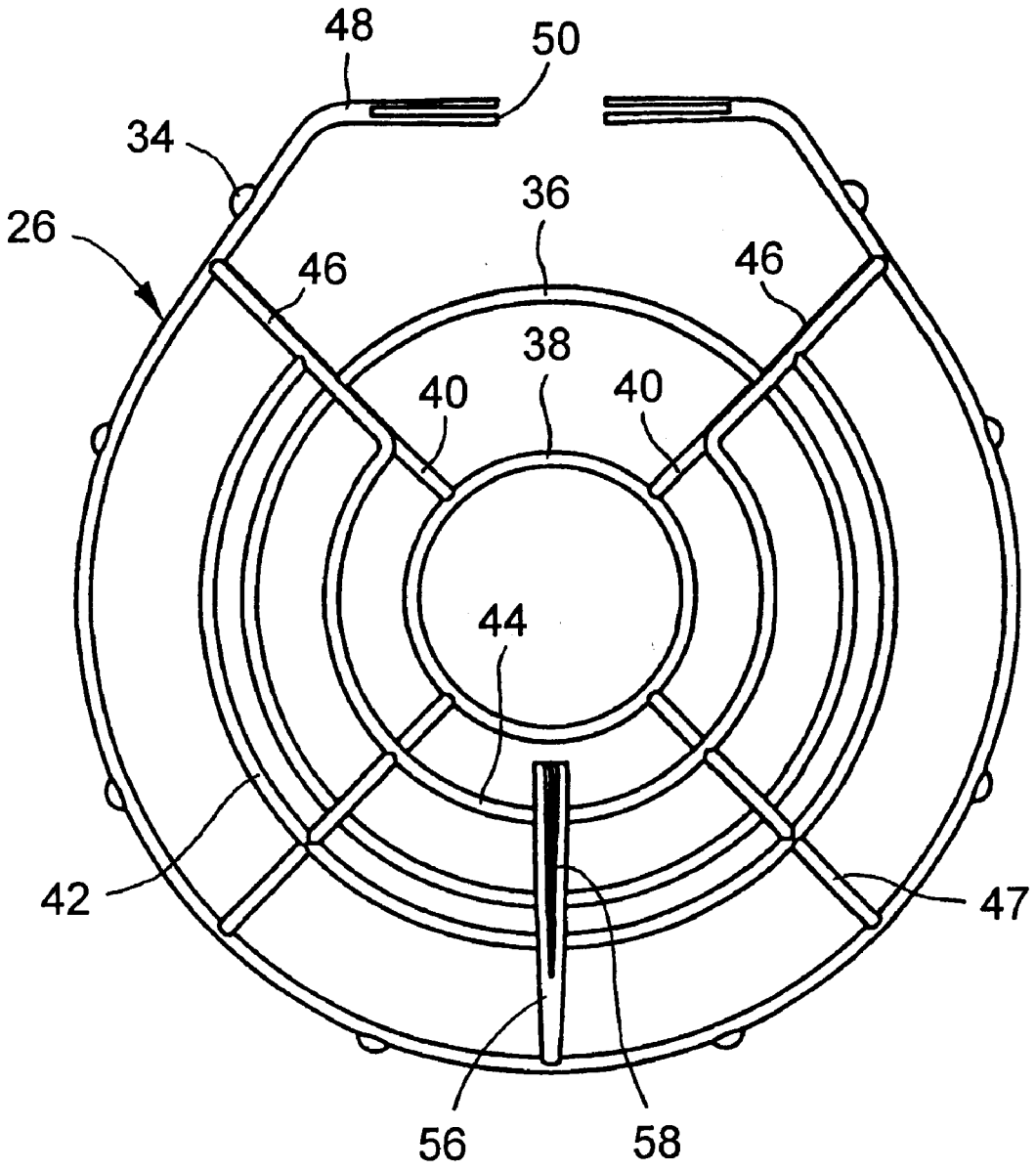
FIG. 3 is a front elevational view of the propeller guard of FIG. 1.
Figure 4:
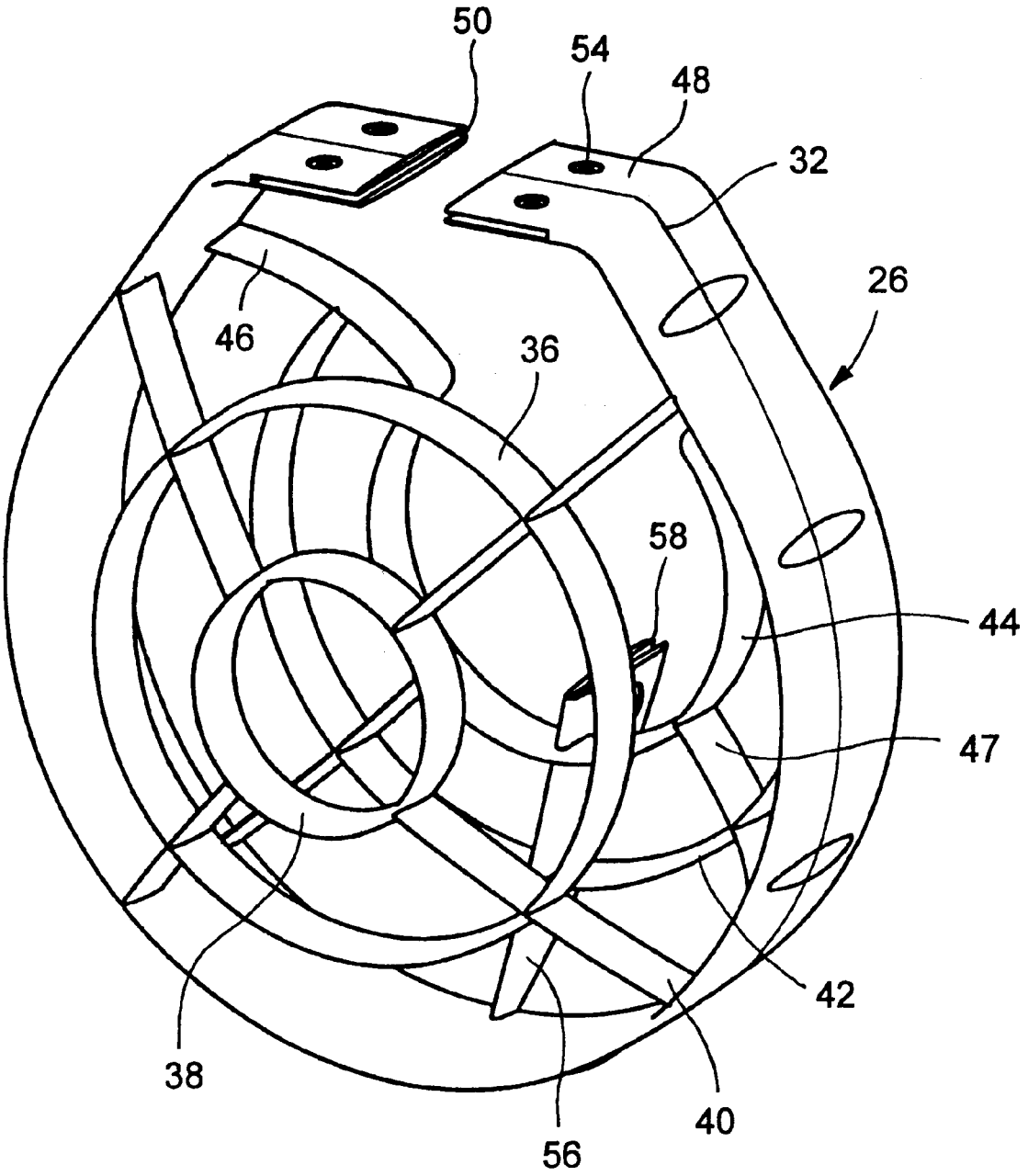
FIG. 4 is a rear prospective view of the propeller guard of FIG. 1.
Figure 5:
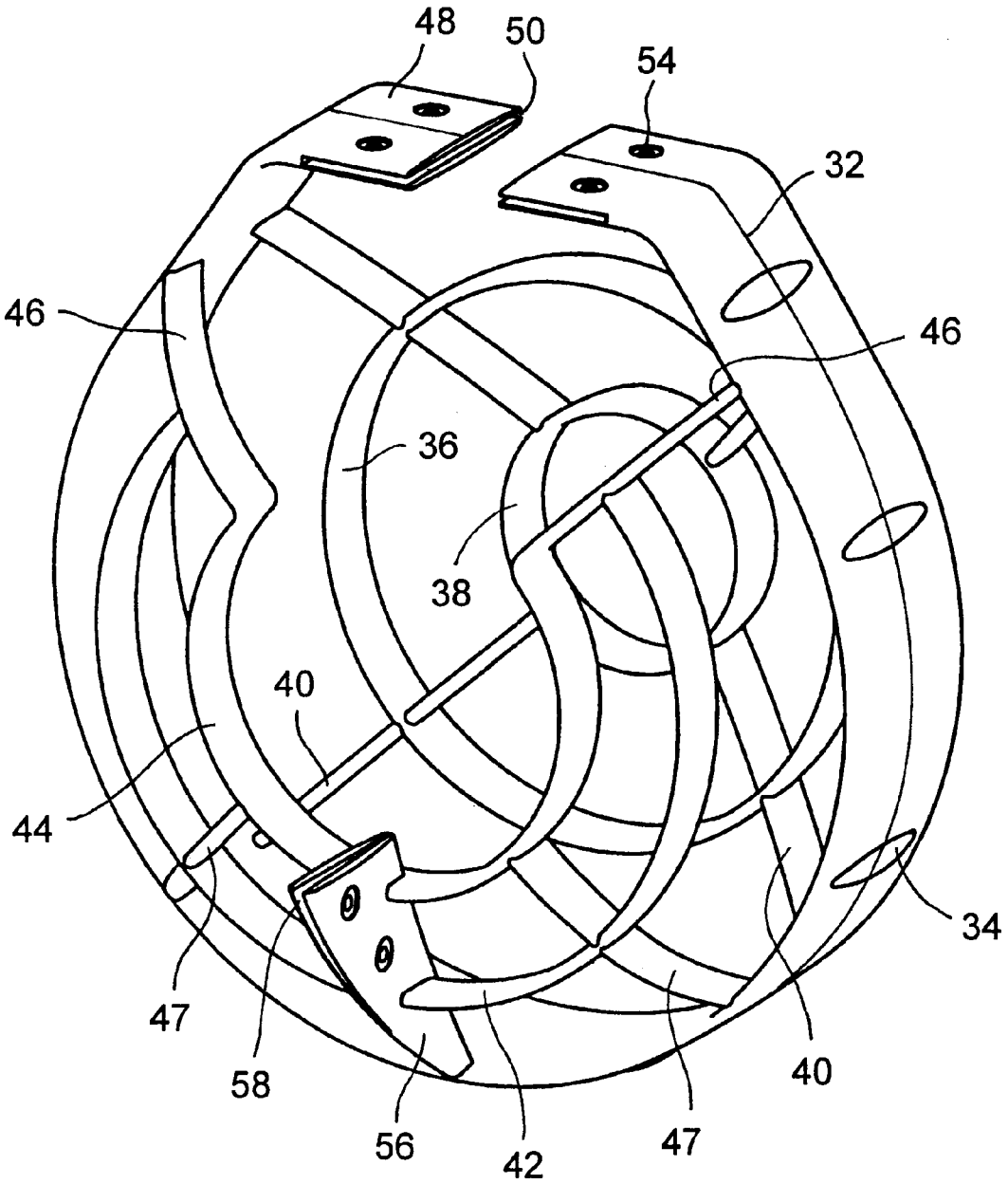
FIG. 5 is a front prospective view of the propeller guard of FIG. 1.

Positioned rearwardly of the central ring 26 is a rear ring 36 which is concentric with respect to the rotational axis of the propeller shaft and propeller 18. Rearwardly of ring 36 is a rear ring 38 of smaller diameter than the ring 36 and spaced axially rearwardly therefrom as illustrated in FIGS. 1 and 4. The annular rings 36 and 38 are concentrically and axially spaced from each other and from the central ring 26 and concentrically spaced from the rotational axis of the propeller 18 as illustrated in FIG. 2. The rings 36 and 38 are rigidly secured in position by a plurality of radially extending and axially inclined support spokes 40 which are of unitary construction with or rigidly connected with the rings 36 and 38 and with the interior of the section 28 of the central ring 26. Thus, the concentric rear and front rings or bands 36 and 38 and the wider central ring 26 combined with the radial support spokes 40 provide protection rearwardly of the propeller to prevent the propeller as well as peripherally thereof from being damaged due to contact with obstacles and also protects human beings, aquatic mammals and the like from injury due to contact with the propeller. The forward portion of the propeller guard 10 is provided with a partial annular ring 42 that is spaced axially forwardly of the central ring 26 and concentric with the rotational axis of the propeller. A smaller partial ring 44 is spaced forwardly of the ring 42 and is concentrically spaced in relation to the ring 42 as illustrated in FIGS. 2 and 5. The partial rings 42 and 44 terminate in a curved mounting bracket 46 at each end thereof which extends outwardly and is integral with the interior of the section 30 of the wide central ring 26 as illustrated in FIG. 5. The mounting brackets or spokes 46 are integral with the terminal ends of the smaller ring 44 and integrally connected to the ends of the larger ring 42 with the support brackets 46 being inclined and curving into engagement with and being integral with section 30 of central ring 26. Also, the portions of the rings 42 and 44 spaced from the brackets 46 are supported by similar curved brackets 47 or spokes as illustrated in FIG. 5. The brackets 47 are also inclined and curved and integrally formed with the partial rings 42 and 44. Thus, the structural components of the central ring 26, the rings 36 and 38, the rings 42 and 44 and the supporting spokes or brackets 40, 46 and 47 are all of unitary construction or of integral construction when assembled onto the propeller drive unit 12.

The propeller guard 10 is attached to the propeller drive unit 12 by the provision of a pair of opposed, spaced mounting brackets 48 at the upper terminal inwardly extending ends of the central ring 26 with the brackets 48 being generally horizontally opposed and spaced from each other and provided with slots 50 which telescopically engage the edges of the cavitation plate 22 as illustrated in FIGS. 6 and 7. The brackets 48 formed by the inturned ends of the central ring 26 are secured to the cavitation plate 22 by fasteners 52 which extend through apertures 54 in the brackets 48. Thus, the propeller guard is secured to the cavitation plate 22 without any modification of the cavity plate 22 other than providing apertures for the fasteners 52.

The lower portion of the propeller guard 10 is secured to the skeg 20 by a radial bracket 56 which has a forwardly facing slot 58 which telescopes over and telescopically receives the rearward edge of the skeg 20 and is secured thereto by fasteners 60. The existing skeg is not modified except for providing apertures for receiving the fasteners 60. With this construction, the upper portion of the propeller guard 10 is securely fastened to the cavitation plate 22 with very little projecting surface area facing the direction of travel or movement of water to reduce resistance to movement. The mounting bracket 56 connected to the skeg also provides very little resistance to movement of the propeller guard through the water or to movement of the water with respect to the propeller guard. Likewise, the edges of the various rings are relatively narrow and the rings are relatively thin but yet sufficiently strong to maintain their shape and configuration and effectively guard the propeller from damage and guard external objects such as human beings, sea mammals or the like from injury due to contact with the propeller.

The propeller guard 10 is relatively light in weight but substantially rigid to provide maximum flow therethrough by virtue of the dimensions being relatively wide in the axial direction and relatively thin in the radial direction. The propeller guard is preferably a two piece injection molded plastic or fiber reinforced resin unit. However, the two piece propeller guard may also be constructed of metal such as aluminum or other suitable metals or other materials. The two pieces of the propeller gurad 10 are separated by a seam located along the center of the wide circumferential central ring 26 that encircles and protects the blade edges of the rotating propeller 18 by virtue of it being aligned with the end edges or peripheral edges of the propeller. In assembly, the sections 28 and 30 of wide central ring 26 is secured together by fasteners 35 after the forward and rearward sections of the propeller guard 10 have been assembled around the propeller 18. The brackets 46, 47 and 48 are then secured to the cavitation plate 22 and skeg 48. The two points of attachment at opposite edges of the cavitation plate 22 and at the rearward edge of the skeg 20 provides a rigid support structure between the propeller drive unit and the propeller guard. The propeller is protected forwardly and rearwardly by the series of generally concentric rings which are axially spaced and supported by circumferentially spaced supporting brackets or spokes which are inclined or curved so that the unit is effectively rigidified and provided with adequate strength for protecting the propeller from damage and preventing injury by contact with the propeller. The construction of the propeller guard minimizes hydrodynamic resistance while maintaining adequate structural integrity and provides protection from injury caused by direct contact with the rotating propeller blade and provides a degree of protection for the propeller from floating or submerged debris or other obstacles.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A propeller guard for protecting a boat propeller from contact with obstacles including floating or underwater debris, human beings, sea mammals and similar items likely to cause damage to the propeller or injury to the item contacted by the propeller, said propeller guard comprising a plurality of generally annular rings oriented in substantially enclosing relation to the propeller, said guard including a central ring oriented in enclosing relation to the propeller and oriented in alignment with the propeller, said guard also including a pair of rear concentric rings oriented in axially spaced relation to each other and in axially spaced relation to the rear of said central ring, said rear concentric rings being concentrically spaced with smaller diameter ring being located aft of the propeller a distance greater than a larger diameter ring, said guard also including forward partial concentric rings located forwardly of the central ring, said forward partial rings being concentric with each other and concentrically spaced in relation to each other and axially spaced in relation to each other and in relation to the central ring, said central ring including structure at an upper portion thereof for mounting the propeller guard on a cavitation plate on a propeller drive unit, and said central ring also including structure at a lower portion thereof for mounting the guard on a skeg on a propeller drive unit.

2. The propeller guard as defined in claim 1 wherein said rear concentric rings are supported in rigid relation to each other and in rigid relation to the central ring by a plurality of radially extending and axially inclined supporting spokes.

3. The propeller guard as defined in claim 2 wherein said forward partial concentric rings are supported in rigid relation to each other and in rigid relation to the central ring by a plurality of radially extending, axially curved supporting spokes.

4. The propeller guard as defined in claim 3 wherein all of said rings, supporting spokes and mounting structures being constructed of a plastic material.

5. The propeller guard as defined in claim 3 wherein said central ring is axially longer than the other rings to provide a stable central area for the propeller guard.

6. The propeller guard as defined in claim 1 wherein said mounting structure at an upper portion of said central ring includes a pair of generally horizontally disposed, laterally spaced brackets at an upper portion thereof, each of said brackets including a slot opening to edge portions thereof for telescopically receiving edge portions of a cavitation plate on the propeller drive unit and fasteners securing the brackets to the cavitation plate.

7. The propeller guard as defined in claim 1 wherein said mounting structure at a lower portion of the central ring includes an upwardly arcuately extending centrally disposed bracket having a forwardly facing slot telescopically receiving a vertical skeg on the propeller drive unit and fasteners securing the bracket to the skeg for anchoring the lower portion of the propeller guard to the propeller drive unit.

8. The propeller guard as defined in claim 1 wherein said central ring is axially wider than the rear and forward rings, said wide central ring including a central seam dividing the central ring into a front and rear section to enable the rear section of the central ring and the rear rings and spokes to be formed independently of the front section of the central ring and the front rings and spokes and enabling assembly of the propeller guard in relation to the propeller drive unit by placing the independently formed sections in enclosing relation to the propeller and joining the sections of the central ring together along said seam.

9. The propeller guard as defined in claim 8 together with fasteners securing said sections of said central ring in assembled relation.

10. The propeller guard as defined in claim 8 wherein said rear concentric rings are supported in rigid relation to each other and in rigid relation to the central ring by a plurality of radially extending and axially inclined supporting spokes.

11. The propeller guard as defined in claim 10 wherein said forward partial concentric rings are supported in rigid relation to each other and in rigid relation to the central ring by a plurality of radially extending, axially curved supporting spokes.

12. The propeller guard as defined in claim 11 wherein said mounting structure at an upper portion of said central ring includes a pair of generally horizontally disposed, laterally spaced brackets at an upper portion thereof, each of said brackets including a slot opening to edge portions thereof for telescopically receiving edge portions of a cavitation plate on the propeller drive unit and fasteners securing the brackets to the cavitation plate.

13. The propeller guard as defined in claim 12 wherein said mounting structure at a lower portion of the central ring includes an upwardly arcuately extending centrally disposed bracket having a forwardly facing slot telescopically receiving a vertical skeg on the propeller driving unit and fasteners securing the bracket to the skeg for anchoring the lower portion of the propeller guard to the propeller drive unit.

14. The propeller guard as defined in claim 13 wherein all of said rings, supporting spokes and mounting structures being constructed of a plastic material.

15. A guard for a propeller comprising a plurality of generally annular rings mounted in substantially enclosing relation to the propeller, said guard including a central ring oriented in enclosing and aligned relation to the propeller, said rings also including at least one rear ring oriented in axially spaced relation to and rearwardly of said central ring, said rings also including at least one forward partial ring oriented in axially spaced relation to and forwardly of said central ring, said rear ring being supported in rigid relation to said central ring by a plurality of radially extending supporting spokes, said forward partial ring being supported in rigid relation to said central ring by a plurality of radially extending supporting spokes.

16. The propeller guard as defined in claim 15 wherein said central ring is axially longer than said rear ring and said forward partial ring.

17. The propeller guard as defined in claim 15 wherein said central ring includes a pair of generally horizontally disposed, laterally spaced brackets at an upper portion thereof, each of said brackets including a slot opening to edge portions thereof for telescopically receiving edge portions of a cavitation plate on a propeller drive unit and fasteners securing the brackets to the cavitation plate, said central ring including an upwardly extending centrally disposed bracket at a lower portion thereof, said upwardly extending bracket including a forwardly facing slot telescopically receiving a vertical skeg on a propeller drive unit and fasteners securing the bracket to the skeg for anchoring the propeller guard to the propeller drive unit.

18. The propeller guard as defined in claim 16 wherein said central ring including a central seam dividing the central ring into a front and rear section to enable the rear section of the central ring and the rear ring and spokes to be formed independently of the front section of the central ring and the forward partial ring and spokes and enabling assembly of the propeller guard in relation to a propeller drive unit by placing the independently formed sections in enclosing relation to the propeller and joining the sections of the central ring together along said seam.

* * * * *